US006485276B2

(12) United States Patent
Yang

(10) Patent No.: US 6,485,276 B2
(45) Date of Patent: Nov. 26, 2002

(54) DUAL FUNCTION AIR PUMP

(76) Inventor: Hsi-Kung Yang, No. 24, Lane 65, San Chun St., Shu Lin Chen, Taipei Hsien (TW)

( * ) Notice: Subject to any disclaimer, the term of this patent is extended or adjusted under 35 U.S.C. 154(b) by 0 days.

(21) Appl. No.: 09/749,347

(22) Filed: Dec. 27, 2000

(65) Prior Publication Data

US 2002/0081209 A1 Jun. 27, 2002

(51) Int. Cl.[7] ..... F04B 17/00; F04B 53/00; F04B 49/00

(52) U.S. Cl. ..... 417/423.14; 417/63; 417/234

(58) Field of Search ..... 417/63, 234, 572, 417/423.14, 442

(56) References Cited

U.S. PATENT DOCUMENTS 4,123,204 A * 10/1978 Scholle ..... 417/393
4,325,163 A * 4/1982 Mattson et al. ..... 15/330
4,789,310 A * 12/1988 Hung ..... 417/234
5,358,385 A * 10/1994 Wang ..... 417/234
5,730,587 A * 3/1998 Snyder et al. ..... 417/413.1

* cited by examiner

*Primary Examiner*—Charles G. Freay
*Assistant Examiner*—Timothy P. Solak
(74) *Attorney, Agent, or Firm*—Alan D. Kamrath; Rider, Bennett, Egan & Arundel

(57) ABSTRACT

A dual function air pump has a compressor with an inlet connected to a first port and with a first outlet connected to a second port. The air to the compressor is directed by a first tube from the first port, such that a suction effect exists at the first port. The air pumped out of the compressor is directed to the second port by a second tube, such that an exhaust or blowing effect exists at the second port. A pressure gauge is connected by an auxiliary tube to the second tube. The compressor further has a second outlet connected to a control switch assembly by a third tube.

2 Claims, 3 Drawing Sheets

DUAL FUNCTION AIR PUMP

BACKGROUND OF THE INVENTION

1. Field of the Invention

The present invention relates to a dual function air pump, and more particularly to an air pump having two nozzles mounted on the body of the air pump to function respectively as a suction nozzle and an exhaust nozzle, such that the user is able to have two different capabilities with a single air pump.

2. Description of Related Art

A conventional air pump only has one nozzle for pumping air, which makes it necessary for a user to buy a suction device when suction is required. For a better understanding of the relationship between the air pump and the suction device, the air pump used to inflate the tire of a vehicle and the suction device used to suck the air out of a container are described.

With reference to FIG. 3, an air pump has a compressor (70) with a head cover (80) mounted on the discharge side of the compressor (70). The head cover (80) has two discharge ports (81, 82) with each port (81, 82) formed to connect to a tube. One of the tubes is connected to an outlet nozzle to inject the air into an object (for example a tire), and the other tube is connected to a pressure gauge so that the user is able to sense the air pressure inside the object.

A suction device is used to suck the air out of a container so that food inside the container will be preserved for a longer time. The suction device can also be used with a flexible storage container, wherein a quilt or the like is placed in the storage container. With the suction device, the air inside the container is sucked out, so that the size of the quilt and the container are reduced for easier storage.

From the two different embodiments, it is noted that the air pump inflates an object and the suction device sucks air out of an object, which shows two different air paths being employed. The user needs to have these two different devices so that air can be pumped into an object and sucked out of an object. However, having these two separate devices at the same time not only is a waste of money, but also is a waste of space when storage is an issue.

In order to overcome the foregoing problems, the invention intends to provide an improved air pump having the capability of pumping air into an object or sucking the air out of an object.

SUMMARY OF THE INVENTION

The primary objective of the invention is to provide an improved air pump having a port connected to an inlet and a port connected to an outlet of the compressor. With such an arrangement, the air pump in accordance with the present invention is able to pump air into an object or selectively suck the air out of an object In order to accomplish the aforementioned objective, the compressor has an inlet, a first outlet and a second outlet. The inlet is connected to a first port by means of a first tube. The first outlet is connected to a second port by means of a second tube. The second outlet is connected to a control switch assembly by means of a third tube. With such an arrangement, the air to the compressor inside the air pump comes from the first port, which creates a suction effect to the surroundings. The air pumped out from the compressor is ejected out of the air pump from the second port, which enables the object receiving the pumped air to be inflated.

Other objects, advantages and novel features of the invention will become more apparent from the following detailed description when taken in conjunction with the accompanying drawings.

DETAILED DESCRIPTION OF PREFERRED EMBODIMENT

Figure 1:
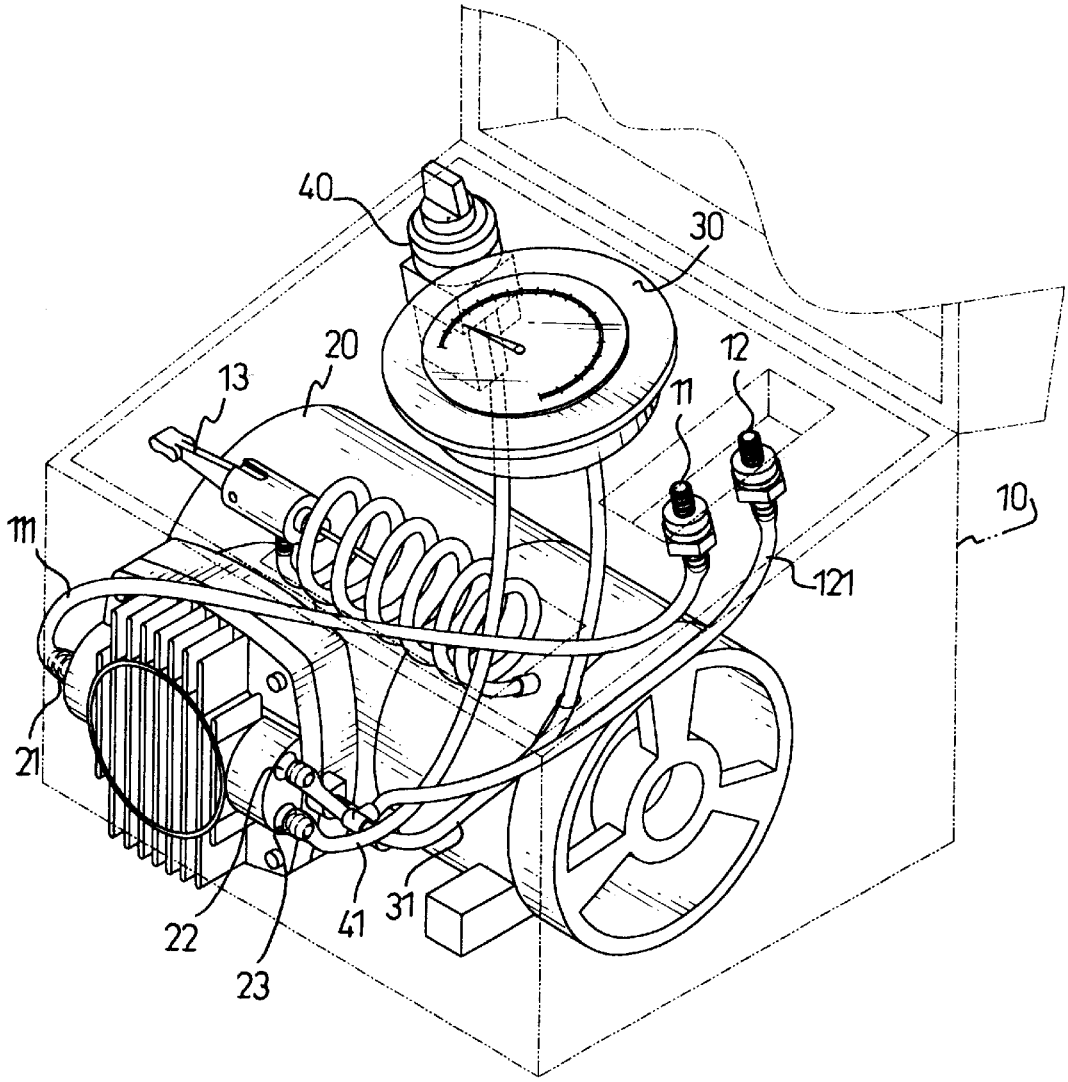
FIG. 1 is a perspective view of an air pump in accordance with the present invention.
Figure 2:
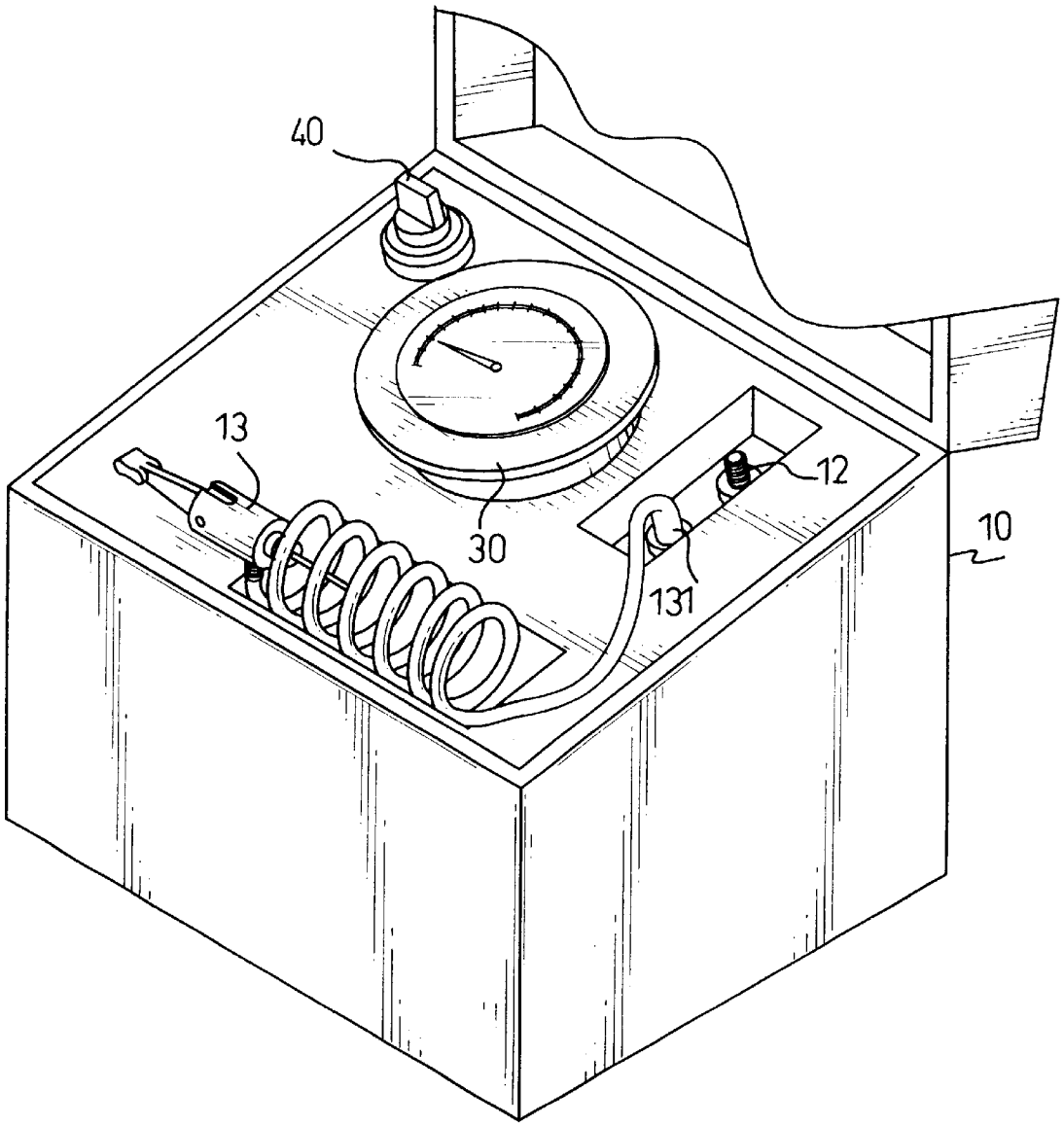
FIG. 2 is an operational perspective view of the air pump in FIG. 1.
Figure 3:
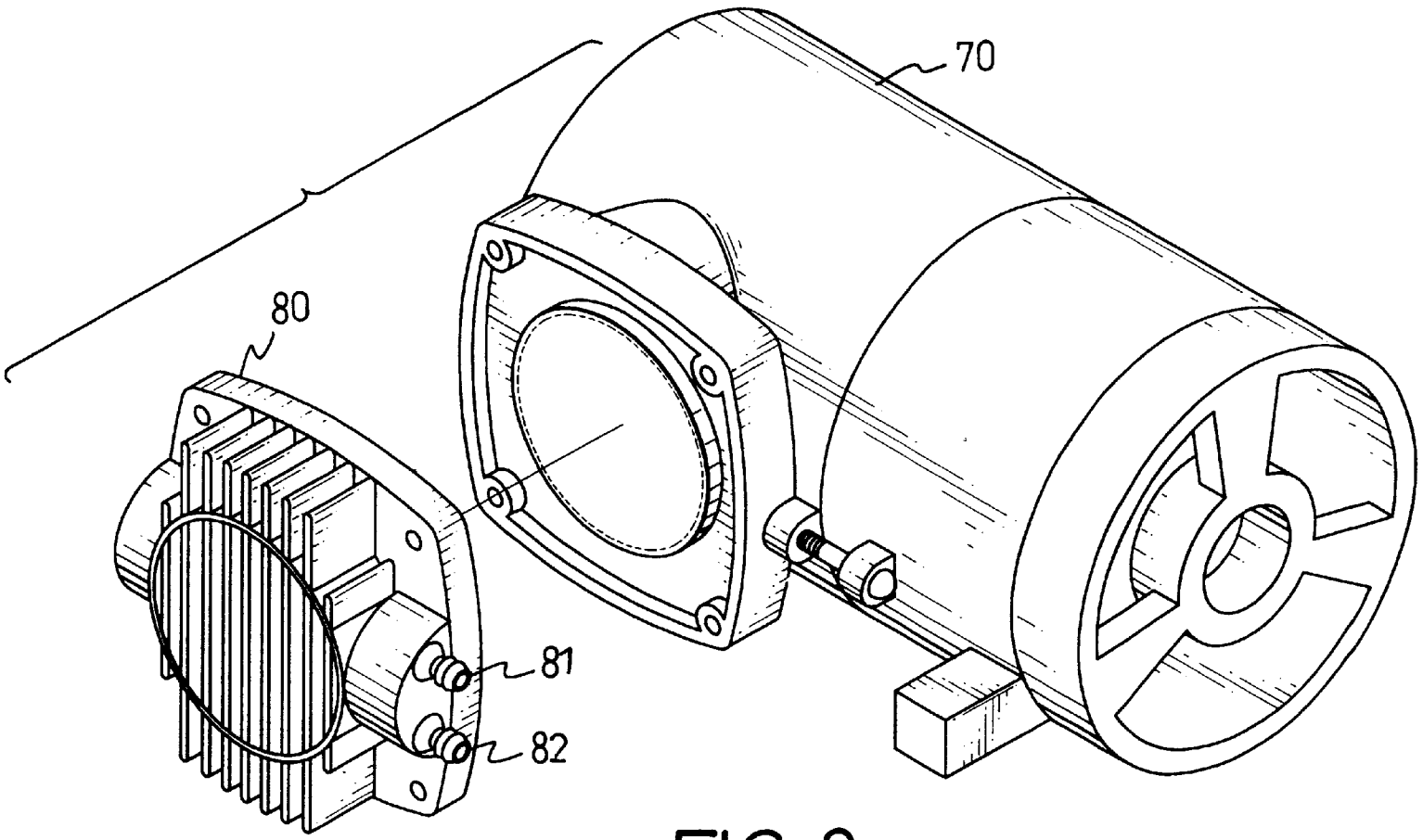
FIG. 3 PRIOR ART
FIG. 3 is a perspective view of a conventional air pump.

With reference to FIG. 1, the air pump in accordance with the present invention has a casing (10), compressor (20), a pressure gauge (30) and a control switch assembly (40).

The casing (10) has a first port (11) and a second port (12) mounted on a surface of the casing (10). The casing (10) further has a nozzle (13) with a connector (131) that is able to connect to either the first port (11) or the second port (12).

The compressor (20) has an inlet (21), a first outlet (22) and a second outlet (23). The inlet (21) is connected to the first port (11) by means of a first tube (111). The first outlet (22) is connected to the second port (12) by means of a second tube (121). The second outlet (23) is connected to the control switch assembly (40) by means of a third tube (41). Further, the pressure gauge (30) is connected to the second tube 121 by means of an auxiliary tube (31).

It is to be noted that the air required by the compressor (20) normally comes from the surrounding air that passes through the inlet (21). The inlet (21) is now sealed by the first tube (111) and is directed to the first port (11), such that a suction effect exists at the first port (11). The air pumped out of the compressor (20) is directed to the second port (12). Therefore, the airflow at the first port (11) and the second port (12) is in opposite directions. Consequently, when the nozzle (13) is connected to the first port (11), the air pump is able to suck the air out of a container, and when the nozzle (13) is connected to the second port (12), the air pump is able to inflate the object. With the communication between the auxiliary tube (31) and the second tube (121), the pressure gauge (30) is able to detect the pressure inside the object being inflated.

The third tube (41) connecting the control switch assembly (40) and the second outlet (23) is used to bleed off a pressure from the compressor (20) to make starting the compressor (20) easier. However, because it is not the issue of this invention, the detailed description is omitted.

The air pump in accordance with the present invention takes advantage of the airflow to and away from the compressor, such that the user is able to use the air pump to inflate an object such as a vehicle tire or to suck the air out of a container for preserving the food inside the container for a much longer period of time.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An air pump comprising:

a casing with a first port and a second port;

a compressor having an inlet connected to the first port by a first tube, having a first outlet connected to the second port by a second tube, and having a second outlet connected to a control switch assembly by a third tube; and a pressure gauge connected to the second tube by an auxiliary tube; and the third tube not being in communication with the second tube and the auxiliary tube outside of the compressor.

2. The air pump as claimed in claim 1 further comprising a nozzle detachably received inside the casing and having a connector selectively connected with the first port or the second port.

* * * * *